US005923354A

United States Patent [19]

Ikezaki

[11] Patent Number: 5,923,354

[45] Date of Patent: Jul. 13, 1999

[54] HOT-MELT INK-JET TYPE PRINTER WITH HEATER OUTSIDE THE PRINT AREA

[75] Inventor: Yoshiyuki Ikezaki, Nagoya, Japan

[73] Assignee: Brother Kogyo Kabushiki Kaisha, Nagoya, Japan

[21] Appl. No.: 08/745,325

[22] Filed: Nov. 8, 1996

[30] Foreign Application Priority Data

Nov. 20, 1995 [JP] Japan ..... 7-326523

[51] Int. Cl.[6] ..... B41J 2/175; B41J 29/38

[52] U.S. Cl. ..... 347/88; 347/17

[58] Field of Search ..... 347/88, 99, 17, 347/23, 12, 26

[56] References Cited

U.S. PATENT DOCUMENTS 5,276,468 1/1994 Deur et al. ..... 347/17

FOREIGN PATENT DOCUMENTS 2-258346 10/1990 Japan ..... 347/17
3-147851 6/1991 Japan ..... 347/88
3-213354 9/1991 Japan ..... 347/26
3253344 11/1991 Japan .
4-358839 11/1992 Japan ..... 347/88

*Primary Examiner*—N. Le
*Assistant Examiner*—Thien Tran
*Attorney, Agent, or Firm*—Oliff & Berridge, PLC

[57] ABSTRACT

A nozzle plate having a nozzle hole defined therein is directly heated from the nozzle side by a heating device such as a halogen lamp in a state of being in non-contact with the heating device. Further, the nozzle plate is indirectly heated from the upper surface side of the nozzle plate by a front heater. The temperature of ink in the vicinity of a nozzle can be increased to an intended ink temperature with efficiency and at an early stage by the application of heat by the heating device and the front heater.

22 Claims, 5 Drawing Sheets

HOT-MELT INK-JET TYPE PRINTER WITH HEATER OUTSIDE THE PRINT AREA

BACKGROUND OF THE INVENTION

1. Field of the Invention

The present invention relates to a hot-melt type ink-jet printer for heating and melting solid hot-melt ink at ordinary temperatures and ejecting the melted ink through a nozzle as liquid ink to thereby print and record characters or the like.

2. Description of the Related Art

An ink-jet printer having a hot-melt type ink-jet head has heretofore been known wherein solid ink is held within an ink tank and is heated and melted so as to be ejected through a nozzle as liquid ink, thereby printing characters. This type of ink-jet printer starts printing after the temperature of each ink passage of the ink-jet head and the temperature of the ink held in the ink tank has reached an intended ink temperature determined according to the type of ink. The term "intended ink temperature" means such a temperature as the viscosity of the ink becomes a value (generally 3 to 50 cPs, preferably 5 to 20 cPs) suited to discharge the ink as droplets.

However, since the ink is exposed to air in the vicinity of the nozzle, although the ink is heated to a sufficiently high temperature within the ink-jet head including the ink tank, the temperature of the ink is lowered and hence becomes apt to be solidified. Therefore, a heating means having a nozzle hole defined in a thermal-conductive plate-like member and provided in the vicinity of the nozzle hole defined in the surface of the plate-like member has been disclosed in Japanese Unexamined Patent Publication No. 3-253344 in order to efficiently prevent the temperature of the ink exposed to air in the vicinity of the nozzle from decreasing.

It is, however, difficult in practice to provide the heating means in the vicinity of the nozzle hole defined in the surface of the plate-like member. Further, the heating means becomes complex in structure. Since only the neighborhood of the nozzle hole is heated, the effect of heating the whole area lying in the vicinity of the nozzle cannot be sufficiently achieved.

SUMMARY OF THE INVENTION

With the foregoing in view, an object of the present invention is to provide a hot-melt type ink-jet printer capable of early increasing the temperature of ink in the vicinity of a nozzle to an intended ink temperature in a simple structure.

A first aspect of the present invention provides a hot-melt type ink-jet printer comprising a hot-melt type ink-jet head for heating and melting solid hot-melt ink at ordinary temperatures and ejecting the melted ink through a nozzle as liquid ink to thereby perform print and recording, a carriage equipped with the ink-jet head, control means for moving the carriage forward and backward alternately within a print area to print information on a recording medium, and first nozzle heating means disposed in a position dislocated from a print area of a travel route of the ink-jet head and for heating the nozzle side of the ink-jet head.

Thus, according to the first aspect of the present invention, the nozzle side of the ink-jet head is heated by the first nozzle heating means located at the position dislocated from the print area of the travel route of the ink-jet head, so that the ink temperature on the nozzle side is raised at an early stage.

A second aspect of the present invention provides the hot-melt type ink-jet printer in the first aspect, wherein the ink-jet head has a second nozzle heating means for heating the nozzle from the back side.

According to the second aspect of the present invention, the neighborhood of the nozzle can be efficiently heated by the first nozzle heating means for heating the nozzle side of the ink-jet head and the second nozzle heating means for heating the nozzle from the reverse side.

A third aspect of the present invention provides the hot-melt type ink-jet printer in the second aspect, wherein the ink-jet head has heating control means for controlling the amount of heat generated by the second nozzle heating means under duty control and the heating control means enhances a duty ratio for a duty signal applied to the second nozzle heating means when the ink-jet head is opposed to the first nozzle heating means.

According to the third aspect of the present invention, the amount of heat generated by the second nozzle heating means is controlled under duty control of the heating control means. When the ink-jet head is placed in opposing relationship to the first nozzle heating means, the duty ratio for the duty signal applied to the second nozzle heating means is enhanced.

A fourth aspect of the present invention provides the hot-melt type ink-jet printer in any of aspects 1 to 3, wherein the first nozzle heating means is a halogen lamp.

According to the fourth aspect of the present invention, the neighborhood of the nozzle can be easily heated in a non-contact state by using the halogen lamp as the first nozzle heating means.

According to the first aspect of the present invention, since the ink-jet head is directly heated from the nozzle side by the first nozzle heating means at the position dislocated from the print area of the travel route of the ink-jet head as described above, the temperature of the ink in the vicinity of the nozzle can be raised to the intended ink temperature with efficiency and at the early stage.

According to the second aspect of the present invention, since the second nozzle heating means for heating the nozzle from the reverse side is provided, the temperature of the ink in the vicinity of the nozzle can be raised efficiently and early owing to a synergistic effect of the application of heat by the first nozzle heating means for directly heating the nozzle side of the ink-jet head and the application of heat by the second nozzle heating means for indirectly heating the nozzle from the back side.

According to the third aspect of the present invention, since the amount of heat generated by the second nozzle heating means is controlled under the duty control of the heating control means and the duty ratio for the duty signal applied to the second nozzle heating means is enhanced when the ink-jet head is opposed to the first nozzle heating means, the temperature of the ink in the vicinity of the nozzle can be early raised under simple control.

According to the fourth aspect of the present invention, since the halogen lamp is used as the first nozzle heating means, the neighborhood of the nozzle of the ink-jet head can be easily heated in a non-contact state.

The above and other objects, features and advantages of the present invention will become apparent from the following description and the appended claims, taken in conjunction with the accompanying drawings in which a preferred embodiment of the present invention is shown by way of illustrative example.

BRIEF DESCRIPTION OF THE DRAWINGS

A preferred embodiment of the present invention will be described in detail with reference to the following figures herein.

DETAILED DESCRIPTION OF PREFERRED EMBODIMENTS

An embodiment of the present invention will hereinafter be described with reference to the accompanying drawings.

Figure 1:
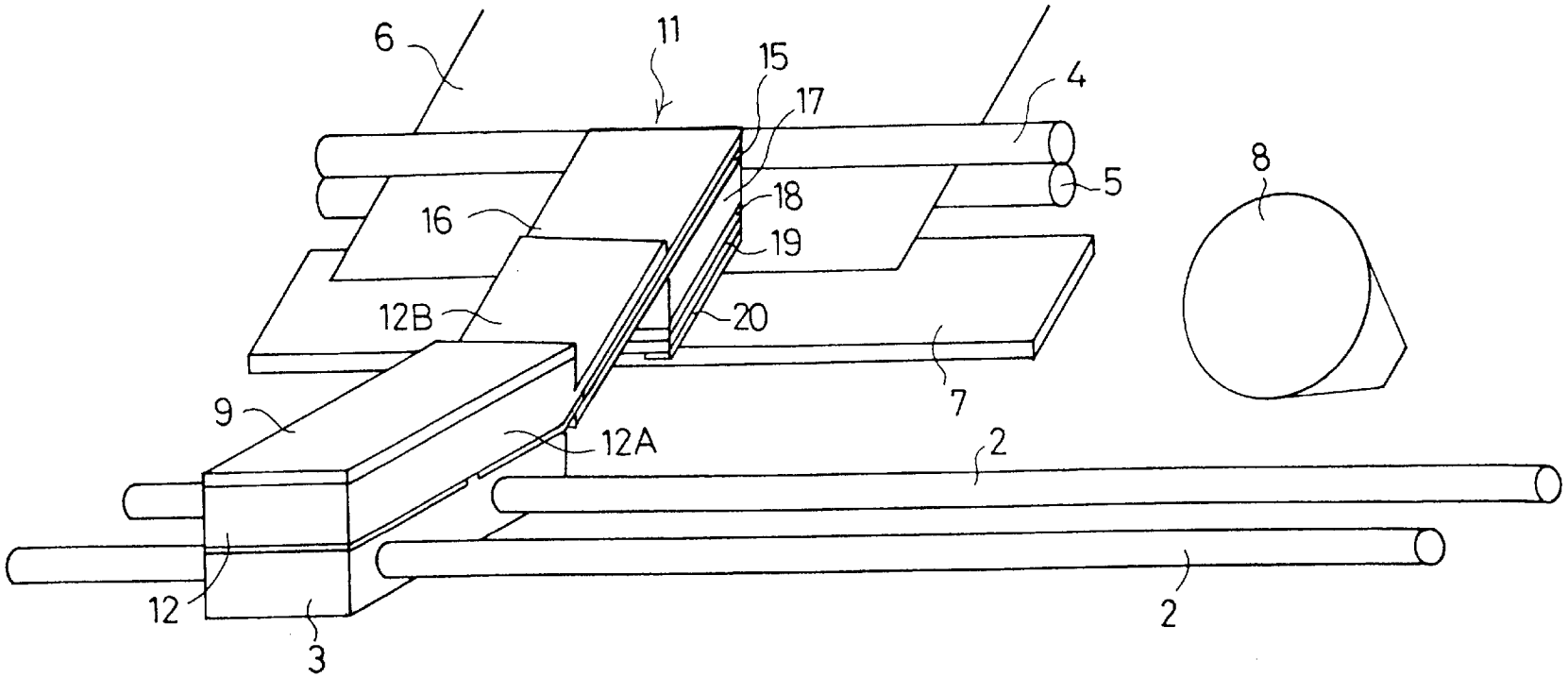
FIG. 1 is a perspective view showing a hot-melt type ink-jet printer according to the present embodiment.

FIG. 1 is a perspective view showing a hot-melt type ink-jet printer. In FIG. 1, the ink-jet printer has a hot-melt type ink-jet head 11 for heating and melting solid ink (whose melting point ranges from 70° C. to 80° C., for example) and printing characters or information by liquid ink (having an ink temperature of about 125° C., for example). The ink-jet head 11 is mounted onto a carriage 3 provided so as to be movable along a pair of guide rails 2 extending in parallel to each other. Thus, the ink-jet head 11 moves forward and backward alternately within a print area in response to reciprocating movements of the carriage 3.

Further, a conveying roller 4 rotatably driven by a drive means is disposed so that the axial line thereof extends substantially in parallel with the direction in which the carriage 3 moves forward and backward alternately. An auxiliary roller 5 is rotatably supported in a correspondence with the conveying roller 4 so that the axial line thereof extends in parallel with the axial line of the conveying roller 4. Printing paper 6 is interposed between the conveying roller 4 and the auxiliary roller 5 and is conveyed in the direction orthogonal to the reciprocating direction of the carriage 3 by friction. The ink-jet head 11 prints characters or the like on the printing paper 6 conveyed in this way on a platen plate 7.

A heating device 8 such as a halogen lamp, for heating a nozzle (specifically, a nozzle plate 20 to be described later) of the ink-jet head 11 directly from the nozzle side is located in a position dislocated from a print area of a travel route of the ink-jet head 11.

Figure 2:
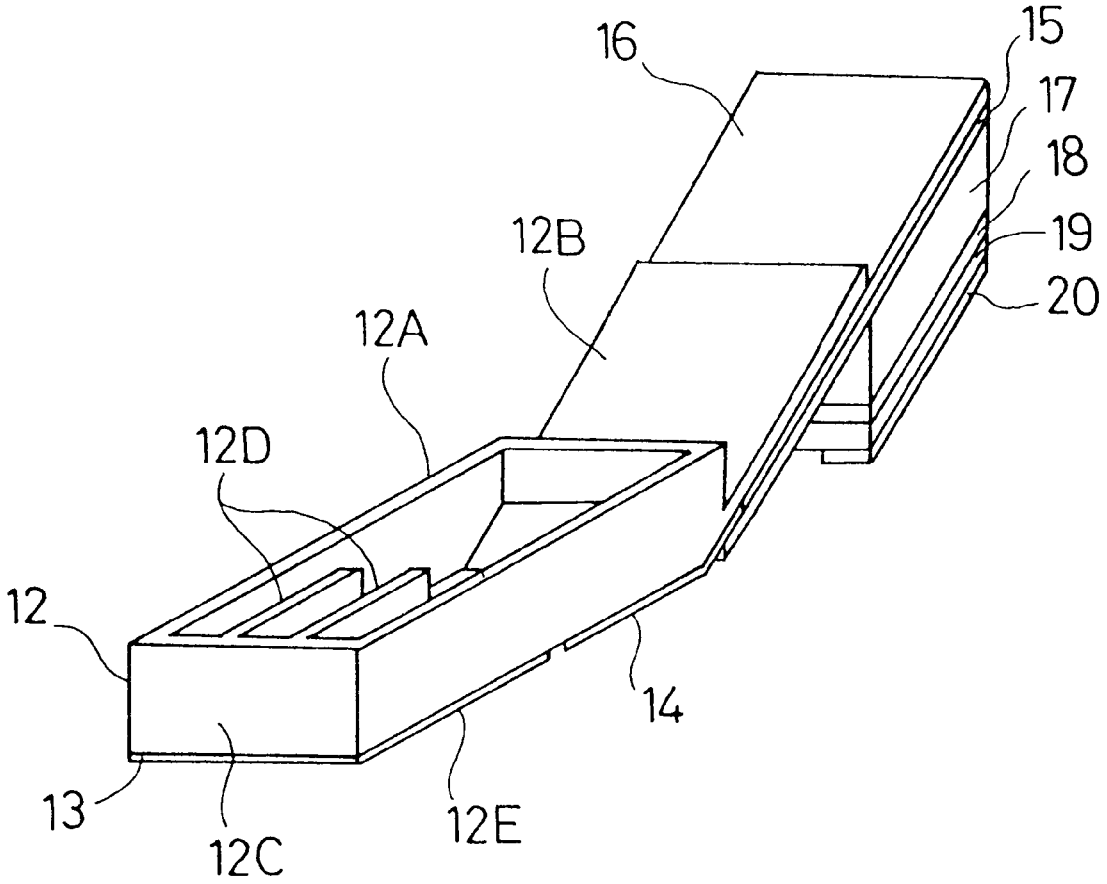
FIG. 2 is a perspective view illustrating a hot-melt type ink-jet head employed in the hot-melt type ink-jet printer shown in FIG. 1.
Figure 7:
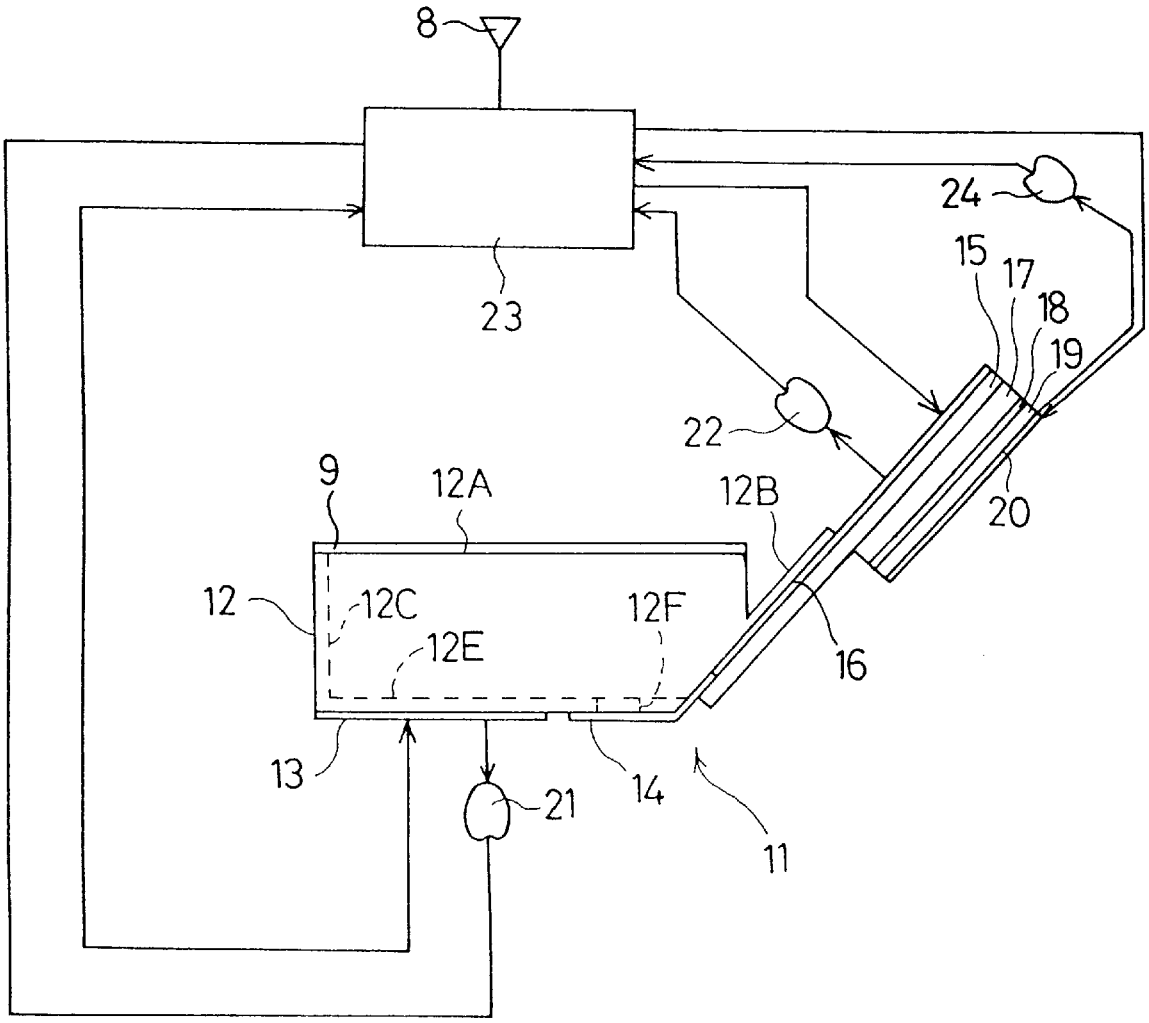
FIG. 7 is a view for explaining a control system of the ink-jet head shown in FIG. 2.

As shown in FIGS. 2 and 7, the ink-jet head 11 has a hollow-shaped ink tank 12 for accommodating the solid ink therein. The ink tank 12 has a substantially rectangular-parallelpiped tank body 12A having an ink supply port 12F defined on one side of a bottom wall portion 12E. A half surface below an outer surface of the tank body 12A, which is provided on the side of provision of the ink supply port 12F, is inclined. Further, a plate-like extension 12B is provided so as to extend from the inclined surface. Two ribs 12D continuously connected to a side wall portion 12C and the bottom wall portion 12E are provided upright in parallel within the inside of the ink tank 12, which is located on the side opposite to the extension 12B.

A tank heater 13 such as a ceramic heater, for heating the ink stored in the ink tank 12 is fixed to the bottom surface of the tank body 12A on the side of provision of the ribs 12D. An upper opening of the tank body 12A is closed with a cover body 9 (see FIG. 1).

A connecting member 14 doglegged in cross section, having an ink passage defined therein which communicates with the ink supply port 12F, is mounted to a portion of the inclined surface of the ink tank 12. A first base plate 15 having another ink passage, which communicates with the ink passage of the connecting member 14, is connected and fixed to the portion thereof through the connecting member 14.

Further, a front heater 16 for heating the nozzle from the back side is provided on the upper surface side (ink tank 12 side) of the first base plate 15. The front heater 16 extends from a lower end of the first base plate 15 to near an upper end of the connecting member 14 through the lower surface of the extension 12B of the ink tank 12.

Figure 3:
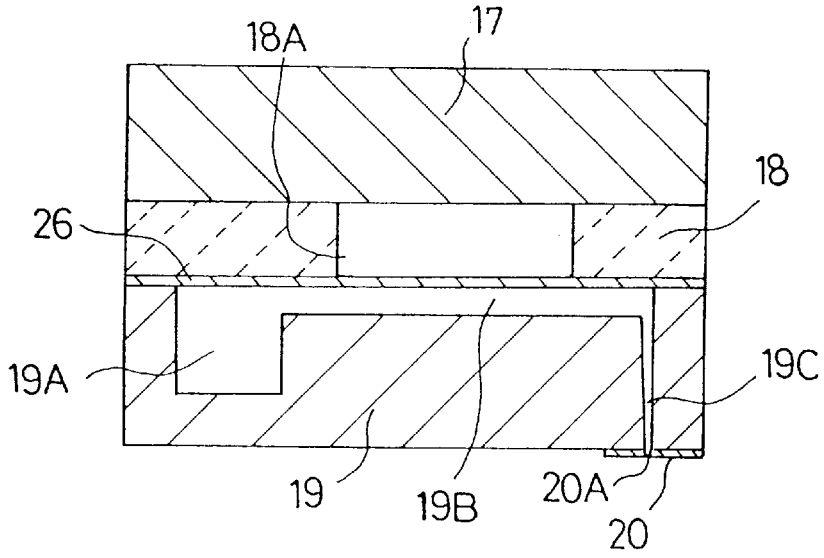
FIG. 3 is a view schematically showing the structure of a principal part of the ink-jet head shown in FIG. 2.
Figure 6:
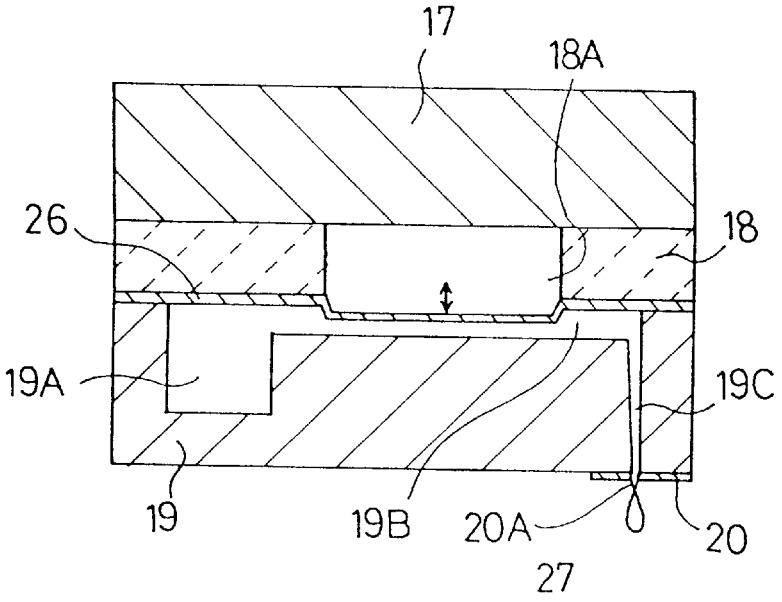
FIG. 6 is a view for explaining the operation of the ink-jet head shown in FIG. 2.
Figure 4:
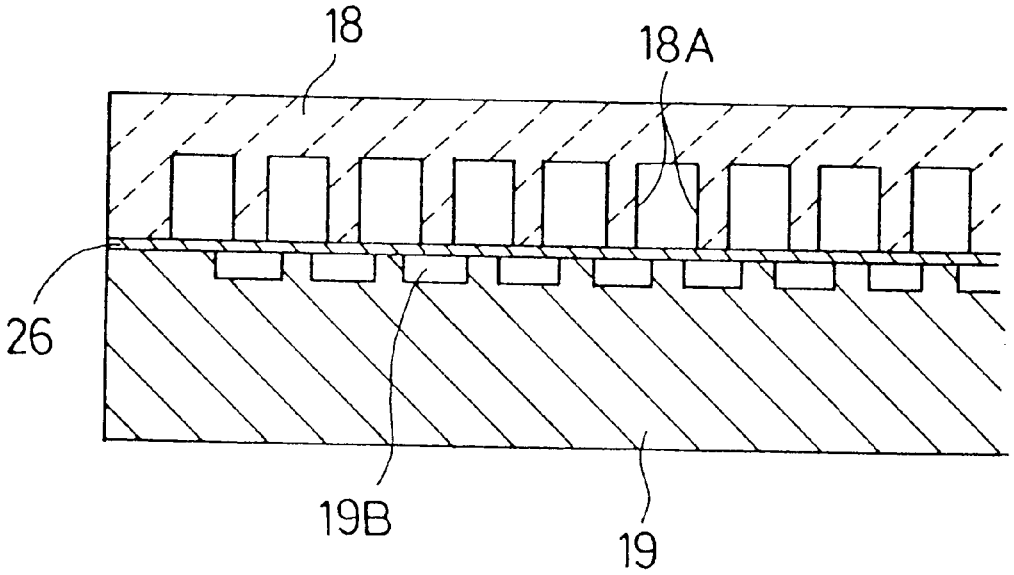
FIG. 4 is a cross-sectional view illustrating the relationship between a piezoelectric element and a cavity plate.
Figure 5:
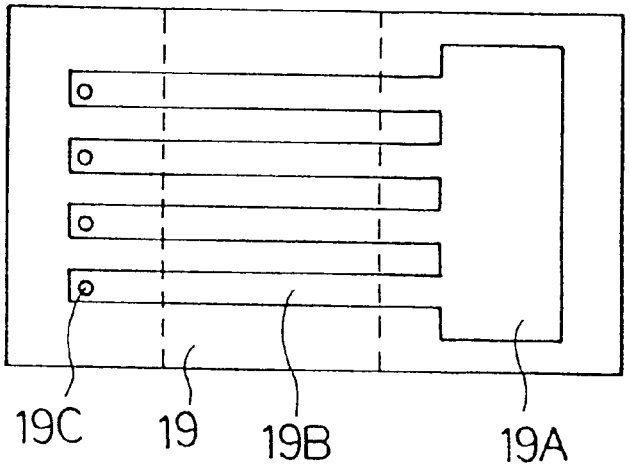
FIG. 5 is a view for describing a cavity structure of the cavity plate shown in FIG. 4.

A second base plate 17 is fixed to the lower surface of the first base plate 15 so as to extend from the upper end thereof to the neighborhood of a portion corresponding to a lower end of the extension 12B. Further, as shown in FIGS. 3 and 4, a piezoelectric element 18 such as a PZT (lead-zirconium-titanate), having a plurality of drive portions 18A for ejecting ink, a cavity plate 19 (see FIG. 5) defining therein an ink supply chamber 19A, ink passages 19B and ink discharge holes 19C for ink ejection, and a nozzle plate 20 having a nozzle hole 20A defined therein through which the ink is ejected, are successively fixed to the lower side of the second base plate 17. A diaphragm 26 having flexibility is interposed between the piezoelectric element 18 and the cavity plate 19. Droplets of ink 27 are ejected through the nozzle hole 20A of the nozzle plate 20 by displacing each drive portion 18A of the piezoelectric element 18 and applying pressure to each ink passage 19B through the diaphragm 26 (refer to FIG. 6).

As shown in FIG. 7, temperature sensors 21 and 22, e.g., thermistors, are respectively connected to the tank heater 13 and the front heater 16. A heater temperature control means 23 for controlling temperatures of both the heaters 13 and 16 to a predetermined temperature under duty control, based on temperature signals produced from the temperature sensors 21 and 22, is linked to the heaters 13 and 16. Described specifically, the heater temperature control means 23 controls the temperatures for heating the heaters so that an ink temperature at each portion, for example, becomes substantially equal to an intended ink temperature at the nozzle. Alternatively, the heater temperature control means 23 controls the heating temperature of the front heater 16 so as to be higher than the intended ink temperature at the nozzle and controls the heating temperature of the tank heater 13 so as to be lower than the intended ink temperature at the nozzle. Further, a temperature sensor 24 such as a thermistor or the like, for measuring an ink temperature in the vicinity of the nozzle is connected to the nozzle plate 20.

The heating device 8 also directly heats the nozzle plate 20 and the nozzle hole 20A from the nozzle side so that the temperature of the ink in the vicinity of the nozzle reaches the intended ink temperature under duty control of the heater temperature control means 23.

Further, the heater temperature control means 23 controls a duty ratio for a duty signal applied to the front heater 16 so as to be enhanced when the ink-jet head is opposed to the heating device 8. The heater temperature control means 23 speeds up an increase in ink temperature in the vicinity of the nozzle owing to a synergistic effect of the application of heat by the heating device 8 and the application of heat by the front heater 16.

The time to most need the power to be consumed by the ink-jet head 11 in order to increase the ink temperatures at the nozzle plate 20 and the nozzle hole 20A is when the solid ink is in a solid-phase state. The solid-phase state is considered to occur when the power is turned ON or when the printer is in a standby state and starts printing after it has entered into an energy-saving mode for maintaining the temperature of the heater or the like at a low temperature. Since the heat in the vicinity of the nozzle is absorbed by a wiper member even when the surface of the nozzle plate is wiped by the wiper member or the like, it is necessary to increase the temperature in the vicinity of the nozzle when printing is started after the wiping operation.

In the above-described case, the ink-jet head 11 is placed in a waiting state at a position out of the print area. At this time, the nozzle plate 20 and the nozzle hole 20A are directly heated from the nozzle side by the heating device 8 and indirectly heated from the upper surface side even by the front heater 16. By doing so, the ink temperatures in the vicinity of the nozzle plate 20 and the nozzle are increased to the intended ink temperatures with efficiency and at an early stage. Since the duty ratio for the duty signal applied to the front heater 16 is controlled so as to be enhanced particularly when the ink-jet head is placed in opposing relationship to the heating device 8, the effect of heating the ink-jet head by the heating device 8 becomes great. When the ink-jet head is heated by the heating device 8 and the attainment of the temperature of the ink in the vicinity of the nozzle to the intended ink temperature (125° C.) is detected by the temperature sensor 24 connected to the nozzle plate 20, the heating of the ink-jet head by the heating device 8 is completed and the duty ratio for the duty signal applied to the front heater 16 is returned to its original state to start printing.

Described specifically, the time required to increase the ink temperature from the ordinary temperature to the intended ink temperature (125° C.) was 154 secs. in a prior art in which a front heater (which consumes 30 watts of power) singly indirectly heats an ink-jet head from the upper surface side, for example. However, when the front heater 16 (whose power consumption: 20W) and the heating device 8 (whose power consumption: 10W) such as the halogen lamp are used in combination, the time required to increase the ink temperature from the ordinary temperature to the intended ink temperature (125° C.) is only 120 secs. As a result, an early temperature increase of 20% or so can be achieved in terms of time as compared with the conventional case where the front heater is used alone.

Since the halogen lamp is used as the heating device 8 in particular, the heating device 8 does not need to make contact with the nozzle plate 20 and can be used in a non-contact state. Therefore, the heating device 8 does not have the adverse affect of damaging the nozzle plate as in the case of the adverse effect of damaging the neighborhood of the nozzle. Further, the ink-jet head 11 can be easily and directly heated from the nozzle side by simply disposing the heating device 8 which consumes the required power.

In the illustrated embodiment, the halogen lamp has been used as the heating device 8. However, the heating device 8 is not necessarily limited to the halogen lamp. Alternatively, other heating devices such as a sheet-like heater, a cartridge heater, etc. may be used.

Having now fully described the invention, it will be apparent to those skilled in the art that many changes and modifications can be made without departing from the spirit or scope of the invention.

What is claimed is:

1. A hot-melt ink-jet printer comprising:

a hot-melt ink-jet head for heating and melting hot-melt ink at ordinary temperatures and ejecting melted hot-melt ink through a nozzle as liquid ink to thereby perform print and recording;

a carriage equipped with said ink-jet head;

a controller for moving said carriage forward and backward alternately within a print area to print information on a recording medium;

a nozzle heater disposed in a position dislocated from a print area of a travel route of said ink-jet head and for directly heating a nozzle side of said ink-jet head when said ink-jet head is positioned in opposing relationship to the nozzle heater so as to melt the solid hot-melt ink in the nozzle and maintain the melted hot-melt ink as a liquid;

an additional nozzle heater for indirectly heating said ink-jet head from a back side of said ink-jet head and located in assocation with the ink-jet head; and a heating controller for controlling an amount of heat generated by said additional nozzle heater under duty control, and wherein said heating controller enhances a duty ratio for a duty signal applied to said additional nozzle heater when said ink-jet head is opposed to said nozzle heater.

2. The hot-melt ink-jet printer as claimed in claim 1, wherein said heating controller includes a heat sensor connected to said ink-jet head.

3. The hot-melt ink-jet printer as claimed in claim 2, further comprising:

a heating controller associated with said nozzle heater for controlling said nozzle heater so that heat is generated therefrom, and an additional heating controller associated with said additional nozzle heater for controlling said additional nozzle heater so that heat is generated therefrom, wherein said heating controller controls said nozzle heater to generate heat from said nozzle heater and said additional heating controller controls said additional nozzle heater to generate said heat from said additional nozzle heater before printing.

4. The hot-melt ink-jet printer as claimed in claim 1, wherein when power to the printer is turned on, a heating controller for controlling said nozzle heater so that heat is generated therefrom controls said nozzle heater to start to generate said heat from said nozzle heater.

5. The hot-melt ink-jet printer as claimed in claim 1, wherein after the printer is in a standby-state or energy-saving mode, a heating controller for controlling said nozzle heater so that heat is generated therefrom controls said nozzle heater to start to generate said heat from said nozzle heater.

6. The hot-melt ink-jet printer as claimed in claim 1, wherein said nozzle heater is selected from the group consisting of a halogen lamp, a sheet heater and a cartridge heater.

7. The hot-melt ink-jet printer as claimed in claim 1, further comprising a heating controller for controlling said nozzle heater, said heating controller including a heat sensor connected to said nozzle side of said ink-jet head.

8. The hot-melt ink-jet printer as claimed in claim 1, wherein said nozzle heater does not directly contact said nozzle side of said ink-jet head.

9. The hot-melt ink-jet printer as claimed in claim 1, wherein said hot-melt ink-jet head comprises:

a vibrating plate;

a piezoelectric element which is attached to a first surface of said vibrating plate and which comprises piezoelectric material and electrodes, said electrodes applying voltages to said piezoelectric material to generate a piezoelectric effect therein;

a cavity plate attached to a second surface of said first surface of said vibrating plate and including a plurality of ink chambers, said cavity plate being changed in volume in accordance with a displacement of said vibrating plate so as to jet melted ink out of said ink chambers; and a nozzle plate attached to said cavity plate and comprising nozzles connected to said ink chambers.

10. The hot-melt ink-jet printer as claimed in claim 1, wherein said hot-melt ink has a melting point of from 70° C. to 80° C. and said melted ink is ejected from said hot-melt ink-jet head at a temperature of about 125° C.

11. A hot-melt ink-jet printer as claimed in claim 1, further comprising:

an ink tank accommodating the hot-melt ink; and a tank heater for heating the hot-melt ink stored in the ink tank, wherein the tank heater is fixed to a bottom surface of the ink tank.

12. A hot-melt ink-jet printer as claimed in claim 11, further comprising a heater controller for controlling under duty control an amount of heat generated by said tank heater and said nozzle heater so that an ink temperature at each portion becomes substantially equal to an intended ink temperature at the nozzle.

13. A hot-melt ink-jet printer as claimed in claim 11, further comprising a heater controller for controlling under duty control an amount of heat generated by said nozzle heater so that a temperature achieved is higher than an intended ink temperature at the nozzle, and controlling under duty control an amount of heat generated by said tank heater so that a temperature achieved is lower than the intended ink temperature at the nozzle.

14. A hot-melt ink-jet printer as claimed in claim 13, further comprising one or more heat sensors connected to said ink-jet head.

15. A hot-melt ink-jet printer as claimed in claim 1, wherein said nozzle heater is a non-contact heater.

16. A hot-melt ink-jet printer as claimed in claim 1, wherein said nozzle heater is a halogen lamp.

17. A hot-melt ink-jet printer comprising:

a guide rail;

a hot-melt ink-jet head for heating and melting a solid ink stored in an ink tank and ejecting the resulting liquid ink through a nozzle to perform printing, said hot-melt ink-jet head being slidably mounted to said guide rail;

a head controller for moving said hot-melt ink-jet head forward and backward along said guide rail;

a nozzle heater disposed in a position dislocated from a print area of a travel route of said hot-melt ink-jet head and for directly heating a nozzle side of said hot-melt ink-jet head when said hot-melt ink-jet head is positioned in opposing relationship to the nozzle heater so as to melt the solid hot-melt ink in the nozzle and maintain the melted hot-melt ink as a liquid;

an additional nozzle heater for indirectly heating said ink-jet head from a back side of said ink-jet head and located in assocation with the ink-jet head; and a heating controller for controlling an amount of heat generated by said additional nozzle heater under duty control, and wherein said heating controller enhances a duty ratio for a duty signal applied to said additional nozzle heater when said ink-jet head is opposed to said nozzle heater;

wherein said printing is conducted by moving said hot-melt ink-jet head along said guide rail within said print area to print information on a recording medium.

18. The hot-melt ink-jet printer as claimed in claim 17, further comprising a carriage and an additional guide rail, wherein said hot-melt ink-jet head is mounted on said carriage, and said carriage is slidably mounted on said guide rail and said additional guide rail.

19. The hot-melt ink-jet printer as claimed in claim 17, further comprising:

a heating controller for controlling said nozzle heater so that heat is generated therefrom, wherein said heating controller controls said nozzle heater to generate said heat from said nozzle heater when said hot-melt ink-jet head is moved by said head controller to a position opposed to said nozzle heater.

20. The hot-melt ink-jet printer as claimed in claim 17, wherein said nozzle heater is selected from the group consisting of a halogen lamp, a sheet heater and a cartridge heater.

21. A hot-melt ink-jet printer as claimed in claim 17, wherein said nozzle heater is a non-contact heater.

22. A hot-melt ink-jet printer as claimed in claim 17, wherein said nozzle heater is a halogen lamp.

* * * * *